US006164292A

United States Patent [19]

Di Maria Poole et al.

[11] Patent Number: 6,164,292

[45] Date of Patent: Dec. 26, 2000

[54] SUPPORT ELEMENT IN THE FORM OF A HELICAL TENSION SPRING, APPLICABLE TO HAIR OR SHEET MATERIAL

[75] Inventors: Sonia Di Maria Poole, Scottsdale, Ariz.; Sandro Di Maria, Milan; Sergio Di Maria, Pioltello, both of Italy

[73] Assignee: Hairdiamond Inc., Phoenix, Ariz.

[21] Appl. No.: 09/355,316

[22] PCT Filed: Jul. 16, 1998

[86] PCT No.: PCT/IB98/01558

§ 371 Date: Nov. 24, 1999

§ 102(e) Date: Nov. 24, 1999

[87] PCT Pub. No.: WO99/04664

PCT Pub. Date: Feb. 4, 1999

[30] Foreign Application Priority Data

Jul. 22, 1997 [IT] Italy ..... MI970559 U
Mar. 16, 1998 [IT] Italy ..... MI98A0531

[51] Int. Cl.[7] ..... A45D 8/12

[52] U.S. Cl. ..... 132/275; 132/273; 132/277

[58] Field of Search ..... 132/275, 273, 132/276, 277, 278; 2/171, 244, DIG. 11; 63/20, 12, 13, 14.1

[56] References Cited

U.S. PATENT DOCUMENTS

| | | | |
|---|---|---|---|
| 44,635 | 7/1864 | Fleischmann . | |
| 250,082 | 11/1881 | Lawrence . | |
| 253,667 | 2/1882 | Bergfels . | |
| 280,726 | 7/1883 | Dutemple . | |
| D. 317,663 | 6/1991 | Calderon . | |
| D. 372,338 | 7/1996 | Engel et al. . | |
| D. 374,306 | 10/1996 | Query . | |
| 401,649 | 4/1889 | Hackett . | |
| 464,810 | 12/1891 | Bonner . | |
| 482,257 | 9/1892 | Larkin . | |
| 574,288 | 12/1896 | Timmons | 132/275 |
| 649,465 | 5/1900 | Littell . | |
| 651,764 | 6/1900 | Mullinix . | |
| 666,860 | 1/1901 | Buzzacott | 132/275 |
| 672,816 | 4/1901 | Bassett . | |
| 674,303 | 5/1901 | Morgan . | |
| 680,873 | 8/1901 | Lord . | |
| 714,431 | 11/1902 | Allen . | |
| 837,615 | 12/1906 | Dover . | |
| 1,039,910 | 10/1912 | Degenhardt | 132/275 |
| 1,515,997 | 2/1924 | Chappell . | |
| 1,725,125 | 8/1929 | Bartley . | |
| 1,864,371 | 3/1932 | Prussian . | |
| 2,033,943 | 3/1936 | Lely . | |
| 2,455,715 | 12/1948 | Webster . | |
| 2,586,787 | 2/1952 | Conto et al. . | |
| 2,924,228 | 2/1960 | McGee . | |
| 3,635,228 | 1/1972 | Heikes | 132/275 |
| 3,739,598 | 6/1973 | Postel | 63/13 |
| 4,741,179 | 5/1988 | McConnell, Jr. . | |

(List continued on next page.)

FOREIGN PATENT DOCUMENTS

| | | | |
|---|---|---|---|
| 21439 | 4/1905 | Austria . | |
| 381831 | 8/1990 | European Pat. Off. . | |
| 459448 | 9/1913 | France . | |
| 929319 | 12/1947 | France | 132/275 |
| 953460 | 11/1956 | Germany . | |
| 3-284210 | 12/1991 | Japan . | |
| 24217 | 11/1901 | United Kingdom . | |
| 14630 | 7/1908 | United Kingdom . | |
| 21486 | 9/1910 | United Kingdom . | |
| 633226 | 12/1949 | United Kingdom . | |

*Primary Examiner*—Pedro Philogene
*Attorney, Agent, or Firm*—Oblon, Spivak, McClelland, Maier & Neustadt, P.C.

[57] ABSTRACT

The support means is applicable to hair (20) or to clothes and accessories which comprise sheet material (38), and which can also be applied in their turn to other objects. It comprises a helical tension spring (10; 30), between the turns of which hair (20) or the sheet material (38) can be retained, provided that through this latter one end (34) of the spring can be inserted (possibly by providing a suitable hole (40). The spring (30) can also act as a setting for a stone (36) by simply inserting the stone between its turns.

3 Claims, 1 Drawing Sheet

U.S. PATENT DOCUMENTS 4,979,276 12/1990 Chimento .
5,271,421 12/1993 Videtzky .
5,318,054 6/1994 Neilson et al. ..... 132/273
5,458,109 10/1995 Tu .
5,495,861 3/1996 Liberman .
5,530,970 7/1996 Knutson .
5,533,363 7/1996 Callisto .
5,564,445 10/1996 Query .
5,638,700 6/1997 Shechter .
5,878,755 3/1999 Crabtree et al. .
6,003,521 12/1999 Huang ..... 132/275

SUPPORT ELEMENT IN THE FORM OF A HELICAL TENSION SPRING, APPLICABLE TO HAIR OR SHEET MATERIAL

TECHNICAL FIELD

This invention relates to a support means usable for the most varied purposes (for example to support decorations and various applications), which can be applied to hair, to clothes or more generally to a sheet material, or can be incorporated in or fixed to other objects.

BACKGROUND ART

Various support or retention means are known (for example of comb, fork, gripper or clip form) for applying decorations to the hair of the head or for forming special hair-styles. These known support means are however ineffective if the hair is of short length, and in any event can only be applied to determined areas of hair (in particular to the hair of the head) and to hair tufts of a certain volume.

These known support means are also rather voluminous and cumbersome.

DISCLOSURE OF THE INVENTION

An object of this invention is to provide a support means applicable to hair (including the hair of the head) which does not present the aforesaid drawbacks of known support means of the aforespecified type.

A further object is to provide a support means of the aforespecified type which can be applied to a material in sheet form and in particular to clothes and accessories such as gloves, hats, handbags, belts and shoes, which comprise sheet material.

It is also known that precious, semi-precious or simply ornamental stones, whether natural or synthetic, are normally mounted in so-called settings which support them, the settings being able in their turn to be fixed to other objects, in particular to jewellery (such as rings, brooches, clips, bracelets). These settings are not easy to manufacture and the the mounting operation, ie fixing the stones to them, is also not simple. In this respect, such an operation requires clinching the edge of the setting or claws projecting from said edge, preparing soldered cages or gluing the stone (in the case of stones of low value). All these operations have to be carried out by specialized personnel and involve the use of special instruments and equipment. Moreover, in mounting the stone or in replacing it, it is exposed to the risk of damage, notwithstanding the skill of the operator. Again, certain mounting methods do not provide high security against loss of the stone resulting from a fall or an accidental blow.

A further object of the invention is to provide a support means for stones which can be applied to hair or to a sheet material, or be fixed to or be incorporated in jewellery and the like.

The said objects are attained by the support means of this invention, characterised by comprising a helical tension spring.

In this respect such a spring can also be easily applied to very short hair (even of a few millimeters in length) by simply stretching the spring or just a part of it so as to widen all or part of its turns respectively, then positioning the hair within these turns. On now releasing the spring, the hair remains trapped between the turns, so that the spring remains fixed to the hair. It has been found that, for this purpose, the spring can even be of very small dimensions (a spring of a few millimeters diameter is sufficient).

As has been ascertained, said support means of helical spring form does not cause any annoyance or sensation of heaviness to the person to whose hair of the head (or hair in general) it has been applied, neither does it cause any painful sensation, even with prolonged use.

Furthermore as such a spring is constructed of fairly fine wire, one end of this wire can be easily inserted through the cloth of clothes by simply resting said end against the cloth and rotating the spring about its axis (in the manner of a screw) so as to cause one or more of its turns to penetrate into the cloth, with the result that the cloth rests trapped between two adjacent turns, which press against it to prevent the spring being able to escape.

In the same manner as hair or cloth, between the turns there can also be interposed an appropriate projection forming part of a decoration or the like, this latter hence being supported by the spring. The decoration can however instead be fixed directly to one end of the spring.

Finally, it has been surprisingly found that the spring is able to reliably retain a stone directly between its turns, so that the spring can basically act as a setting.

BRIEF DESCRIPTION OF THE DRAWINGS

The invention will be more apparent from the ensuing description of two embodiments thereof. In this description reference is made to the accompanying drawing, in which.

BEST MODE FOR CARRYING OUT THE INVENTION

Figure 1:
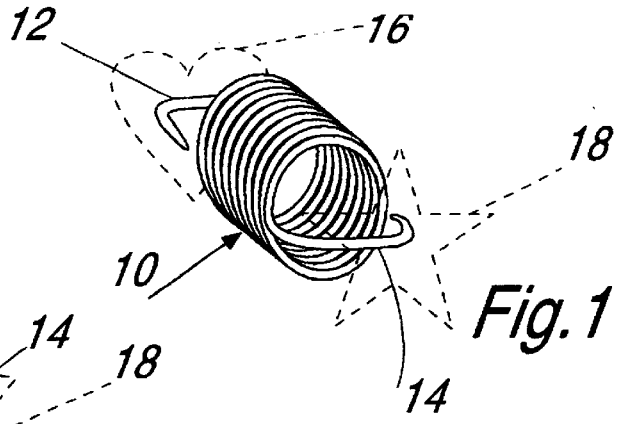
FIG. 1 is a perspective view of a first support means in the form of a helical tension spring.
Figure 2:
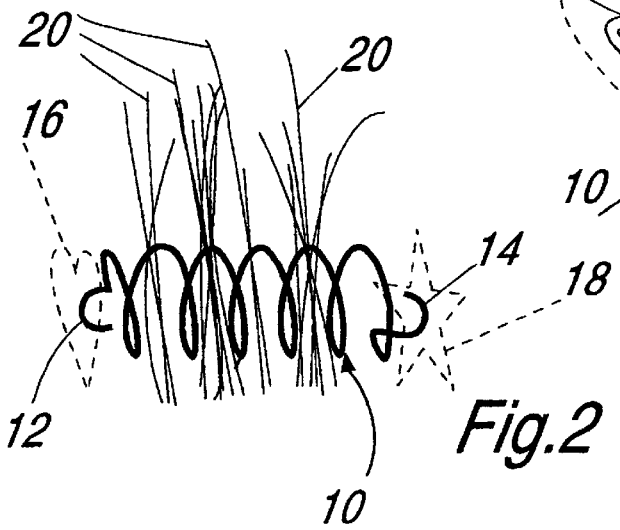
FIG. 2 shows its application to a tuft of hair from the head of an individual or other hair.
Figure 3:
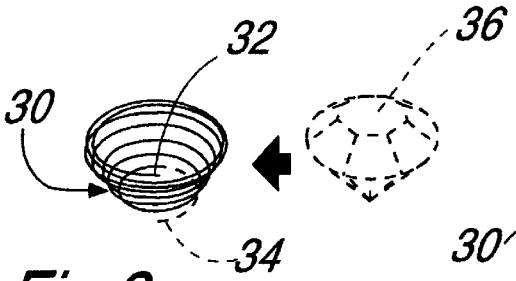
FIG. 3 is a perspective view of a second support means in the form of a helical tension spring, in which the diameter of the turns thereof gradually decreases from one end of the spring to the other.
Figure 4:
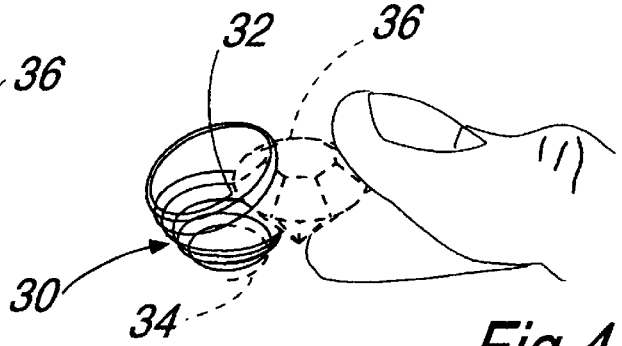
FIG. 4 shows the support means of FIG. 3 with a stone being mounted thereon.

As can be seen from FIGS. 1 and 2, the support means comprises a spring 10 the geometrical shape of which is that of a helix described on a right circular cylinder (known as a circular helix). The spring 10 is of the tension type, each turn pressing against an adjacent turn. In the illustrated specific case, both ends of the spring 10 form a kind of arm, 12 and 14 respectively. Decorations (in the specific case a heart 16 and a star 18, shown by dashed lines) can be fixed to one or both arms 12 and 14 (for example by soldering or gluing). These decorations can be of the most varied types or can be dispensed with, the spring in itself then constituting a decoration.

By pulling on both ends of the spring 10, the stretched spring situation shown in FIG. 2 is obtained. It is then possible to arrange hair 20 of the head, or hair in general, between the turns of the spring 10. On now releasing the spring 10 the hair 20 remains trapped between its turns. The result (in this specific case) is hence that the heart 16 and the star 20 remain fixed to the hair 20, to obtain a decorative effect.

It should be noted that the spring 10 can be of very small dimensions (even a few millimeters in diameter, and therefore of minimum weight) compared with known means for applying decorations to the hair, these latter means being decidedly more cumbersome and heavy.

Using the support means 10 it is also possible to obtain original hair-styles, by applying to the hair the most varied decorations.

It should be noted that instead of fixing the decorations directly to the terminal arms of the spring 10 (as in the case of the star 18 and heart 16), the decorations can be retained by providing them with one or more filaments or stems which can be retained by the turns of the spring 10 in the manner of the hair 20.

Removing the support means 10 from its application is likewise simple. The spring needs merely to be stretched to automatically release the hair 20 or the like trapped between its turns.

It has been found that the support means of spring type according to the invention is very reliable in the sense that, once applied to a tuft of hair, it is practically impossible for it to escape.

The aforedescribed support means can be usefully used to fix wigs, false hair, veils, ribbons or other objects for application to the hair.

The ends of the spring 10 can also be shaped as a closed hook or a ring in order to be able to suspend trinkets or various decorations from it.

Figure 5:
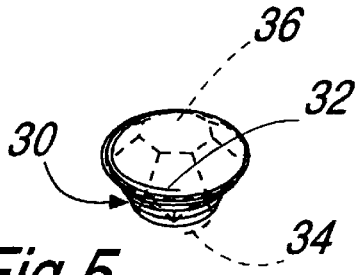
FIG. 5 shows it with mounting completed, the spring acting as the setting.

Referring now to FIGS. 3–6, it can be seen that the spring 30 is again of helical type, but the initial turns, in this specific case the first three, of the upper part of the spring 30 have a diameter which slightly increases from the top downwards, the turn diameter then decreasing significantly until the corresponding turn at the lower end of the spring. In this specific case (FIG. 4) by inserting between the third and fourth turn a stone 36 (shown by dashed lines) of diameter equal to or slightly greater than the diameter of the largest-diameter turn (the third from the top), the stone 36 is well retained by the overlying turns, as shown in FIG. 5.

As can be seen, in the case of the spring 30 its ends 32 and 34 (to render it visible, the end 34 is shown slightly displaced and by a dashed line) are not bent in the manner of arms (as in the case of the spring 10).

It should be noted that the stone 36 can be inserted into the spring 30 manually in an extremely simple and rapid manner (but could also be done automatically by an appropriate machine). It should also be noted that, contrary to what one would expect, the stone is retained by the spring 30 in a very reliable manner, with the advantage of having a mounting cost considerably less than that of known mounting methods.

Figure 6:
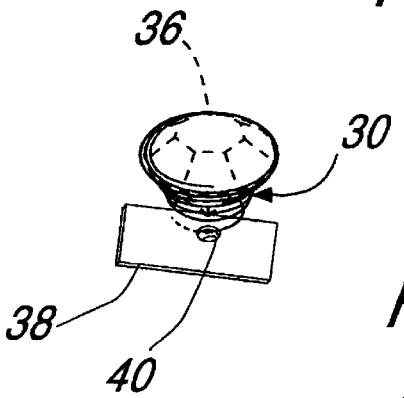
FIG. 6 shows the application of the setting of FIG. 5 to any material in sheet form.

If desired, the spring 30 with the stone 36 retained by it can be applied to a tuft of head or other hair (as in the case of the spring 10). Alternatively this spring (but if desired also the spring 10) can be applied to an article of clothing or to accessories provided they comprise a material in sheet form which enables it to be applied (FIG. 6 shows schematically a piece of material indicated by 38). In the specific case of FIG. 6, the sheet material 38 is provided with a hole 40 into which the end of the spring 30 is inserted. By rotating the spring 30 manually through a few revolutions (in the manner of a screw), the spring 30 (and hence the stone 36) can be securely fixed to the sheet material 38. If the sheet material is cloth (but this applies also to other materials) it is not even necessary to provide the hole 40, as the end 34 of the spring 30 can be equally inserted between the component threads of the cloth.

Figure 7:
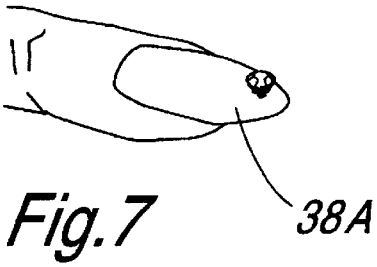
FIG. 7 shows the application of the setting of FIG. 5 to a fingernail.

FIG. 7 shows a setting such as that of FIG. 6, in which however the sheet material is a fingernail 38A in which a hole (not visible) has been previously formed.

It should be noted that those turns of the spring 30 which lie above and retain the stone 36 provide proper protection for the stone against impact and falling, the spring acting as a shock absorber.

Figure 8:
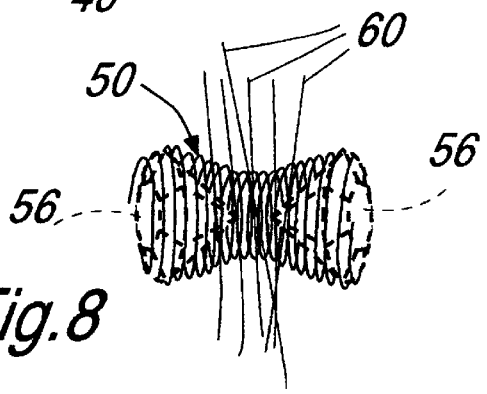
FIG. 8 shows a modification of the support element of the invention, in which the spring is of hour-glass shape.

It should also be noted that the spring of the support means according to the invention can be shaped differently from the springs 10 and 30 shown on the drawings. For example the spring can have its end turns of equal diameter and its intermediate turns of lesser diameter, to hence obtain a spring of hour-glass shape, as in FIG. 8. The spring 50 of FIG. 8 is particularly applicable to very short hair 60 and acts as a setting for two stones 56 (shown by dashed lines). These latter can also be dispensed with, in which case the spring 50 itself acts as the decorative element.

It should be noted that the term "helical spring" used herein can also mean a spring having turns which are not circular but in the shape of broken lines. In particular, when viewed in plan, each turn can for example reproduce the perimeter of a square, a rectangle, a hexagon, or more generally a polygon.

The shape of the spring turns governs in practice the shape of the stone mounted in it, and vice versa. In particular, to mount a stone of rectangular profile viewed in plan, a spring with rectangular turns should be used, for an oval stone oval turns, and so on.

Finally, it should be noted that instead of being applied to hair or to sheet material, the support means of the invention could simply serve as a support for stones (ie as a setting) to then be fixed to or be incorporated into other objects. For example, using a spring of which the end turns, or those close to the end, have a diameter greater than the intermediate turns (shaped for example as an hour-glass, such as that of FIG. 8), a series of such springs—carrying a relative stone in proximity to one end (in the aforedescribed manner)—can be inserted in a groove provided in a piece of jewellery and having a cross-section equal to the lateral profile of the spring. Hence when the various springs have been inserted or forced into said groove they are retained therein, but with the stones visible.

A support means of the type indicated by 30 in FIG. 5 can evidently also be fixed to a piece of jewellery by simply suitably soldering the free end 34 of the spring directly to the jewellery.

What is claimed is:

1. A support which is attachable to hair, a sheet of material or another object, which comprises:

a helical tension spring, said spring having a helix with turns which are substantially circularly shaped at least one of an end turn and a turn in proximity with said end turn, having a diameter greater than a diameter of other turns of said spring, wherein said spring comprises intermediate turns which have a diameter which decreases in a direction towards a center portion of the spring, such that said spring comprises an hour-glass shaped spring.

2. A support attachable to hair, a sheet of material or another object, which comprises:

a helical tension spring, said spring comprising a setting for a stone insertable between two adjacent turns of said spring, wherein turns of the spring lying above the outer face of the stone decrease in diameter in a direction away from the stone.

3. A support as claimed in claim 2, wherein turns of the spring lying below the stone decrease in diameter in a direction away from the stone.

* * * * *

UNITED STATES PATENT AND TRADEMARK OFFICE

CERTIFICATE OF CORRECTION

PATENT NO. : 6,164,292
DATED : December 26, 2000
INVENTOR(S) : Sonia Di Maria Poole, et al.

It is certified that error appears in the above-identified patent and that said Letters Patent is hereby corrected as shown below:

Title page,
Item [30], the Foreign Application Priority Data is listed incorrectly. Item [30] should read as follows:

-- [30] Foreign Application Priority Data

| | | | |
|---|---|---|---|
| Jul. 22, 1997 | [IT] | Italy | MI97U000559 |
| Mar. 16, 1998 | [IT] | Italy | MI98A000531 -- |

Signed and Sealed this

Twenty-third Day of October, 2001

*Attest:*

Nicholas P. Godici

*Attesting Officer*

NICHOLAS P. GODICI
*Acting Director of the United States Patent and Trademark Office*